US010018041B2

(12) United States Patent
Wachsmann et al.

(10) Patent No.: US 10,018,041 B2
(45) Date of Patent: Jul. 10, 2018

(54) TOOL DEVICE FOR A GROUND MILLING MACHINE AND GROUND MILLING MACHINE HAVING SUCH A TOOL DEVICE

(71) Applicant: BOMAG GMBH, Boppard (DE)

(72) Inventors: Steffen Wachsmann, Koblenz (DE); Markus Schaefer, Braubach (DE)

(73) Assignee: BOMAG GMBH, Boppard (DE)

( * ) Notice: Subject to any disclaimer, the term of this patent is extended or adjusted under 35 U.S.C. 154(b) by 0 days.

(21) Appl. No.: 15/524,797

(22) PCT Filed: Nov. 5, 2015

(86) PCT No.: PCT/EP2015/002230
§ 371 (c)(1),
(2) Date: May 5, 2017

(87) PCT Pub. No.: WO2016/071001
PCT Pub. Date: May 12, 2016

(65) Prior Publication Data

US 2017/0321551 A1 Nov. 9, 2017

(30) Foreign Application Priority Data

Nov. 7, 2014 (DE) ..... 10 2014 016 500

(51) Int. Cl.
*E21C 35/19* (2006.01)
*E21C 35/183* (2006.01)
(Continued)

(52) U.S. Cl.
CPC ..... *E21C 35/19* (2013.01); *E21C 35/183* (2013.01); *E01C 23/088* (2013.01); *E21C 25/10* (2013.01); *E21C 2035/1806* (2013.01)

(58) Field of Classification Search
CPC ..... E21C 35/18; E21C 2035/1806; E21C 2035/1816; E21C 2035/1826; E21C 35/19;
(Continued)

(56) References Cited

U.S. PATENT DOCUMENTS 1,615,738 A * 1/1927 Bowman ..... B21L 15/00 299/103
4,076,318 A * 2/1978 Hauschopp ..... E21C 27/44 299/103
(Continued)

FOREIGN PATENT DOCUMENTS

CN 102518032 6/2012
DE 102013020679 6/2013
(Continued)

OTHER PUBLICATIONS

International Search Report from corresponding PCT Appln. No. PCT/EP2015/002230 dated Apr. 20, 2016.

*Primary Examiner* — Sunil Singh
(74) *Attorney, Agent, or Firm* — Grossman, Tucker, Perreault & Pfleger, PLLC

(57) ABSTRACT

The invention relates to a tool device for a ground milling machine, particularly a road milling machine, a recycler, a stabilizer or a surface miner. The tool device comprises a milling chisel with a highly wear-resistant chisel tip, particularly comprising PCD material, and a chisel shaft extending along a longitudinal axis, and a chisel holder with a shaft receptacle, the chisel shaft of the milling chisel having at least one tapering section narrowing in a direction away from the chisel tip. Furthermore, a fastening device is provided, which is designed in such a way that it pulls the milling chisel along its longitudinal axis and in the direction away from the chisel tip into the shaft receptacle, the shaft receptacle of the chisel holder being designed complemen-
(Continued)

tary to the chisel shaft of the milling chisel in such a way that the tapering section, when braced by the fastening device, bears against the chisel holder in the shaft receptacle in a frictionally locking manner shaft receptacle. The chisel holder also comprises a base holder and a quick-change chisel holder, the base holder comprising a holder receptacle for receiving the quick-change chisel holder, and the quick-change chisel holder comprising the shaft receptacle, and the fastening device being designed in such a way that it pulls both the milling chisel along its longitudinal axis and in the direction away from the chisel tip into the shaft receptacle as well as the quick-change chisel holder into the holder receptacle in the base holder. The invention also relates to a milling chisel and a quick-change chisel holder for such a tool device and a ground milling machine with such a tool device.

19 Claims, 5 Drawing Sheets

(51) Int. Cl.
*E21C 35/18* (2006.01)
*E21C 25/10* (2006.01)
*E01C 23/088* (2006.01)

(58) Field of Classification Search
CPC ..... E21C 2035/191; E21C 35/193; E21C 35/1933; E21C 35/1936
USPC ..... 299/79.1, 100–111, 112 R, 112 T, 113
See application file for complete search history.

(56) References Cited

U.S. PATENT DOCUMENTS

| | | | | |
|---|---|---|---|---|
| 4,299,424 | A * | 11/1981 | LeBegue | E21C 35/183 299/103 |
| 5,374,111 | A * | 12/1994 | Den Besten | E21C 35/18 299/106 |
| 7,992,944 | B2 * | 8/2011 | Hall | E21C 35/183 299/110 |
| 2012/0068527 | A1 | 3/2012 | Erdmann et al. | |
| 2012/0080930 | A1 * | 4/2012 | Latham | B28D 1/188 299/104 |
| 2013/0207445 | A1 * | 8/2013 | Bell | E21C 35/18 299/105 |
| 2013/0307316 | A1 | 11/2013 | Roetsch et al. | |
| 2014/0225418 | A1 * | 8/2014 | Lachmann | E21C 35/183 299/104 |

FOREIGN PATENT DOCUMENTS

| | | | |
|---|---|---|---|
| DE | 102013002639 | | 8/2014 |
| GB | 2505569 | A * | 3/2014 |
| WO | 03/006165 | | 1/2003 |
| WO | WO 03/006165 | A1 * | 1/2003 |

* cited by examiner

TOOL DEVICE FOR A GROUND MILLING MACHINE AND GROUND MILLING MACHINE HAVING SUCH A TOOL DEVICE

FIELD

The invention relates to a tool device for a ground milling machine, particularly a road milling machine, a recycler, a stabilizer or a surface miner, comprising a milling chisel with a highly wear-resistant chisel tip, particularly comprising PCD material, and a chisel shaft extending along a longitudinal axis, and a chisel holder with a shaft receptacle. The invention also relates to a milling chisel and a quick-change chisel holder for such a tool device, and a ground milling machine having a tool device according to the invention.

BACKGROUND

These types of ground milling machines are usually used in road and path construction and in surface mining of natural resources. The most often comprise a machine frame or chassis, an operator's platform, and multiple running gears. Furthermore, they have a drive engine, which is usually a diesel engine, by which the ground milling machine, particularly its running gears and the working device, is powered. These types of ground milling machines are known, for example, from DE 10 2013 020 679 A1 and DE 10 2013 002 639 A1 of the same applicant.

The working device of the ground milling machine is a milling drum that is typically mounted in a milling drum box, which is closed to the sides and to the top and is open towards the ground, such that it can be rotated about its rotation axis, said rotation axis most often extending horizontally and transversely to the working direction. The milling drum is designed, for example, in the form of a hollow cylinder and equipped with a plurality of tool devices on its outer jacket surface. The tool devices comprise, for example, respectively one milling chisel and one chisel holder. The chisel holder is connected to the milling tube of the milling drum and holds the milling chisel. The milling chisel may be, for example, an integral piece or, alternatively, it may comprise multiple components, particularly a base holder and a quick-change chisel holder attached to the base holder, which in turn is designed for receiving the milling chisel. Reference is made to DE 10 2010 044 649 A1 and DE 10 2010 051 048 A1 of the same applicant with respect to the structure of such tool devices. During work operation of the ground milling machine, the tool devices are driven into the ground through the rotation of the milling drum, thereby milling the ground. As the ground milling machine advances in the working direction during milling operation, the ground material is milled along a milling track. Depending on the machine type and application, the loose milled material may then be transferred via a discharge conveyor to a transport vehicle and hauled away by it (typically in the case of surface miners and road milling machines) or it may remain on the surface (typically in the case of stabilizers and recyclers).

During the milling process, the tool devices, particularly the milling chisels, are subjected to heavy wear. The milling chisels of the tool devices must therefore be regularly replaced. It may likewise occur that the chisel holders are also either heavily worn or damaged due to a milling chisel breaking. In this case, the chisel holder must also be replaced. For chisel holders which comprise a base holder and a quick-change chisel holder, it may suffice if the quick-change chisel holder is replaced together with the milling chisel.

As regards the mounting of the milling chisel, it is known to attach it in the chisel holder so that the chisel can rotate. So-called clamping sleeves are usually used for this purpose. However, the rotatable mounting of the chisel in the chisel holder also involves disadvantages. In addition to the increased material use and installation effort, the rotation of the milling chisel itself results in increased wear between the chisel shaft and the clamping sleeve as well as between the wear plate and the holder. Therefore, it is also known to arrange the milling chisel in or on the chisel holder such that the chisel cannot rotate. To this end, the milling chisel may be soldered, for example, directly onto the chisel holder or mounted in the chisel holder by means of a press fit. This type of connection is frequently considered, for example, if the used milling chisels include materials with a relatively high degree of hardness. The disadvantage of such design variants then lies in the fact that once the milling chisel has reached its wear limit, the change procedure is relatively complex. It is then frequently necessary to replace the chisel holder or the quick-change chisel holder together with the milling chisel as a modular unit, even if only the milling chisel is actually worn and needs to be changed. Furthermore, the new installation of the milling chisel is relatively time consuming and complicated. In addition, especially when using soldered connections, the hardness or resistance of the material in the wear area is diminished through the heat input in the chisel holder during soldering.

SUMMARY

In light of this, the object of the present invention is to provide a generic tool device, for which the installation and changing of the milling chisel are streamlined and simplified. It should be possible to replace a milling chisel without having to likewise replace the chisel holder or the quick-change chisel holder. It is desirable that the milling chisel in the chisel holder can be installed quickly and easily. Moreover, when assembled, the milling chisel in the chisel holder should ideally be mounted in a non-rotational manner such that it does not rotate about its longitudinal axis within the chisel holder during milling operation.

This object is achieved with a tool device, a milling chisel, a quick-change chisel holder, and a ground milling machine as disclosed.

Specifically, with a generic tool device, the object is achieved in that the chisel shaft of the milling chisel has at least one tapering section narrowing in the direction away from the chisel tip, that a fastening device is provided, which is designed in such a way that it draws the milling chisel, along its longitudinal axis and in the direction away from the chisel tip, into the shaft receptacle, and that the shaft receptacle of the chisel holder is at least partly designed complementary to the chisel shaft of the milling chisel in such a way that, when braced by the fastening device, the tapering section at least partly fits in the shaft receptacle in the chisel holder in a frictionally-locked manner.

In this context, the chisel shaft refers to that part of the milling chisel which is located behind the chisel head cutting the ground material in the tool's direction of advance. In contrast to the chisel head, which penetrates directly into the ground material and mills it, the chisel shaft serves to mount and attach the milling chisel on the chisel holder. The chisel shaft therefore particularly refers to that part of the milling chisel, which, when installed, is located within the chisel holder or which is guided into and partly even through the shaft receptacle during installation. In this respect, it is not necessary that all components of the chisel shaft fit directly on the chisel holder; it is in fact sufficient if areas provided for this are in contact with the chisel holder. To install the milling chisel, the chisel shaft is guided into the shaft receptacle of the chisel holder, which typically is an elongated, tunnel-like recess in the chisel holder. The shaft receptacle thus refers to that part on the chisel holder, which serves to receive and mount the chisel shaft. The fastening device serves exclusively to fasten the chisel shaft in the shaft receptacle and therefore the milling chisel itself within the chisel holder. According to the invention, the milling chisel fits directly on at least one subarea of the shaft receptacle of the chisel holder particularly with the tapering section described below.

The milling chisel according to the invention has a chisel tip and a face side located on the shaft end opposite the chisel tip, as well as a longitudinal axis extending between these two ends of the milling chisel. The milling chisel can be designed, for example, as a round shaft chisel that is rotationally symmetric about its longitudinal axis, although embodiments are also comprised by the invention which are not necessarily designed in a rotationally symmetric manner, for example, with respect to the design of the chisel tip. The tapering section of the chisel shaft runs between a wide and a narrow end. On the wide end, the chisel shaft has a larger extension than on the narrow end at least in a direction radial to the longitudinal axis of the milling chisel. The tapering section is thus characterized by the fact that, in this area, the extension of the chisel shaft transversely to the longitudinal axis decreases in a direction away from the chisel tip and towards the narrow end. The wide end is thus positioned towards the chisel tip, while the narrow end of the tapering area faces the end of the shaft. Thus, the chisel shaft narrows or tapers in a direction from the wide end of the tapering section towards the narrow end, or in the "direction of insertion" of the milling chisel into the shaft receptacle. In this regard, it is important that, on the side of the tapering section facing away from the chisel tip, the chisel shaft does not reach the diameter or cross-sectional area which it has on the wide end of the tapering section. As a result, the tapering section forms an insertion stop, with which the chisel shaft stops on the shaft receptacle of the chisel holder when the milling chisel is pushed into the shaft receptacle along its longitudinal axis.

The shaft receptacle is formed in such a way that it can receive the chisel shaft at least partly in a manner as precise or form locking as possible. The shaft receptacle is a receiving opening, particularly a passage opening completely penetrating the chisel holder, the milling chisel being located with its tapering section at least partially and particularly completely within the shaft receptacle when installed. Due to the design of the tapering section according to the invention, a stop area is formed, in which the chisel shaft with its tapering section bears against the inner wall of the shaft receptacle in a form locking manner and cannot be pushed any further into the shaft receptacle. The chisel shaft is formed in such a way that it can be inserted from outside into the shaft receptacle until the stop occurs between the tapering section and the shaft receptacle. It is principally possible that the diameter or the cross-sectional area of the chisel shaft increases again in the area adjoining the narrow end of the tapering section, although not to the diameter or cross-sectional area of the wide end of the tapering section. However, it is preferable if the diameter or the cross-sectional area of the chisel shaft in a direction from the tapering section towards the end of the shaft does not exceed the diameter or the cross-sectional area of the narrow end of the tapering section. For example, a cylindrical section having a constant diameter can be connected to the narrow end of the tapering section.

In principle, the tapering section can be of any form as long as the diameter or the cross-sectional area of the chisel shaft decreases at least partly along the longitudinal axis of the milling chisel in the tapering section. For example, a step-like tapering having any number of steps may be provided. However, the tapering in the tapering section preferably occurs not in steps but continuously. Therefore, the tapering section particularly preferably does not comprise any surfaces running vertically to the longitudinal axis of the milling chisel. For example, a rounded, particularly conical, tapering is possible, for example, based on a paraboloid, particularly an elliptical paraboloid. However, it is particularly preferred if the tapering section is designed as a truncated cone, i.e., with side edges running in a straight line in a plane along the longitudinal axis. This shape is relatively easy to produce and provides for very good force transfer from the milling chisel to the chisel holder. Moreover, a particularly reliable and strong frictional connection can be achieved with this design between the tapering section of the chisel shaft and the section designed at least partly complementary to it within the chisel receptacle. It is further preferable if the chisel shaft, particularly the tapering section, and the shaft receptacle are designed in such a way that the milling chisel is centered in the shaft receptacle through the installation. This centering enables a particularly stable fastening of the milling chisel on the chisel holder. This may be accomplished, for example, by designing the tapering section as well as the shaft receptacle as rotationally symmetrical relative to the longitudinal axis of the milling chisel at least in the contact area of the tapering section.

The design of the milling chisel and its fastening in the chisel holder according to the invention enables a particularly simple and quick fastening of the milling chisel. In addition, it is beneficial that the chisel can be turned after a certain period of use to slow the progression of wear on the tool. For this purpose, the chisel is removed, turned, and then fastened again so it does not rotate. Moreover, the milling chisel does not need to be additionally soldered in the chisel holder, so that the material properties are not negatively affected through excessive heating of the chisel holder. At the same time, a particularly reliable transfer of forces from the chisel holder onto the milling chisel and vice versa is established by the tapering section bearing against the shaft receptacle. According to the invention, the milling chisel is braced in the chisel holder by means of the fastening device in such a way that it is non-rotationally locked during normal work operation through the frictional connection between the shaft receptacle and the tapering section. This means in particular that the milling chisel does not rotate within the shaft receptacle during work operation. Highly wear-resistant chisel tips are used in this case. For these types of milling chisels with chisel tips comprising a highly wear-resistant material, a rotation of the milling chisel in the chisel holder is not desirable. In the present context, highly wear-resistant materials are particularly those materials that comprise a Mohs hardness of at least 9.5 and preferably at least 10. These highly wear-resistant materials are therefore particularly boron nitride, tungsten carbide or other hard metals. A particularly suitable highly wear-resistant material is a so-called PCD material (polycrystalline diamond, particularly with the designation "DP" according to ISO 513). PCD materials are characterized by the fact that they comprise synthetically manufactured diamonds. They are usually randomly dispersed in a metal matrix, which acts as a carrier material. The diamonds themselves typically have a Mohs hardness of 10. The chisel tips according to the invention are therefore characterized by the fact that they wear very little in work operation compared to conventional chisel tips and thus achieve very long lifetimes. Alternatively to the Mohs hardness, the invention also encompasses highly wear-resistant materials with a Vickers hardness according to DIN EN ISO 6507-1:2006-03 of at least HV 2400, preferably at least HV 4000, more preferably at least HV 6000, more preferably at least 8000, and most preferably at least HV 10000. The particular hardness test may alternatively also be conducted according to Knoop (DIN EN ISO 4545-1 to -4), while according to the invention, materials being used in this case having a Knoop scale hardness greater than 1300 and particularly greater than 4000.

With the arrangement according to the invention, forces acting on the chisel tip, particularly during milling operation, are diverted largely via the tapering section or the contact surfaces between the tapering section and the chisel holder. Thus, it is particularly advantageous if this contact surface is especially large. Therefore, in relation to the chisel shaft as a whole, the tapering section is preferably designed in such a way that the tapering section of the chisel shaft extends over at least 25% of the shaft length, preferably over at least 50%, more preferably over at least 75%, and most preferably over at least 90% of the shaft length, for example, essentially over the entire length of the shaft. The shaft receptacle is accordingly preferably designed complementary to the chisel shaft in such a way that the tapering section preferably bears against the shaft receptacle over its entire length. A larger contact surface enables a beneficial force distribution and prevents the milling chisel from breaking away from the chisel holder under extreme loads.

In principle, the tapering section of the chisel shaft may be arranged at any location along the chisel shaft. It is likewise possible, for example, that additional tapering sections are arranged upstream or downstream the at least one tapering section along the longitudinal axis of the milling chisel. Particularly with respect to forces that impact the milling chisel vertically to its longitudinal axis, however, it is particularly preferable if the tapering section of the chisel shaft directly adjoins the chisel head of the milling chisel. As the tapering section then also bears against the chisel holder or the shaft receptacle of the chisel holder directly behind the chisel head, forces acting on the milling chisel or on the chisel head, for example, through the collision of the milling chisel with the ground material to be milled, can be diverted directly behind the tool head into the chisel holder. The milling chisel therefore sits particularly steadily in the tool receptacle even in extreme operating conditions and is stabilized by it. Bending moments acting on the chisel shaft can be reduced or diverted into the chisel holder particularly well due to this arrangement.

According to the invention, the chisel holder involves a multi-component chisel holder, comprising a quick-change chisel holder and a base holder. The base holder has a holder receptacle for receiving the quick-change chisel holder and the quick-change chisel holder has the shaft receptacle for receiving the chisel shaft. With such a two-part chisel holder, it is possible, for example, to exchange or replace only the milling chisel and the quick-change chisel holder, while the base holder, which is usually protected against the abrasive wear of the milled material by the milling chisel and the quick-change chisel holder, may continue to be used. Thus, on the one hand, material costs for the base holder can be saved, which does not need to be replaced with it. On the other hand, it is likewise possible to achieve an installation option for the milling chisel and the quick-change chisel holder via the base holder, which enable a faster installation than an all new welding of a complete chisel holder to the milling drum and subsequently equipping it with a milling chisel.

According to the invention, the milling chisel and the quick-change chisel holder are both simultaneously fastened to the base holder via a single common fastening device. To this end, the fastening device is designed in such a way that it pulls both the milling chisel along its longitudinal axis and in the direction away from the chisel tip into the shaft receptacle and the quick-change chisel holder into the holder receptacle in the base holder and braces them. The fastening device thus fastens both the milling chisel to the quick-change chisel holder and the quick-change chisel holder to the base holder. As a result, no separate fastening device needs to be provided for the quick-change chisel holder. The design of the tool device is therefore considerably simplified, manufacturing costs are lowered, and the installation time is decreased.

In principle, the portion of the quick-change chisel holder designed for fastening might have any shape complementary to the holder receptacle. For example, it is conceivable that the quick-change chisel holder is secured against rotation in the holder receptacle in a form locking manner. However, it has been found that a particularly beneficial force transfer is enabled in all directions from the quick-change chisel holder to the base holder if the quick-change chisel holder likewise bears against the base holder in a frictionally-locked manner. Thus, it is preferred that the quick-change chisel holder bears against the base holder in a frictionally-locked manner and the milling chisel bears against the quick-change chisel holder in a frictionally-locked manner. Both frictional connections are preferably achieved simultaneously by tightening the fastening device, which pulls the milling chisel against the quick-change chisel holder and the quick-change chisel holder against the base holder.

Accordingly, in a specific embodiment of the invention, the milling chisel has a stop surface, with which it bears against the quick-change chisel holder in the direction of insertion, and that the quick-change chisel holder has a stop surface, with which it bears against the base holder in the direction of insertion. A basic idea of this preferred embodiment of the invention is then to respectively design these contact surfaces as a tapering section. Accordingly, it is preferred that the milling chisel as well as the quick-change chisel holder respectively have at least one tapering section, the tapering section of the milling chisel bearing against the quick-change chisel holder and the tapering section of the quick-change chisel holder bearing against the base holder. In general, everything that was previously outlined regarding the tapering section of the milling chisel or the chisel shaft applies for the tapering section of the quick-change chisel holder. Due to the fact that the milling chisel and the quick-change chisel holder each have a tapering section and the shaft receptacle and the holder receptacle are each designed complementary to the respective tapering sections, the stop surfaces according to the invention are provided in a particularly easy and efficient manner.

Because the milling chisel and the quick-change chisel holder are fastened by a single fastening device, it is beneficial if the milling chisel and the quick-change chisel holder and the associated shaft receptacle and the holder receptacle are designed in such a way that a form- and frictionally locked stopping occurs between these components when the milling chisel and the quick-change chisel holder are pulled in the same direction. Such pulling can then be provided by a single fastening device. This can also be structurally achieved particularly easily if the tapering sections of the milling chisel and the quick-change chisel holder narrow in the direction away from the chisel tip, or in the direction of insertion. The tapering sections of the milling chisel and the quick-change chisel holder are thus equally oriented with respect to their wide and narrow ends. The stops of the milling chisel and the quick-change chisel holder against each other or on the base holder can therefore be achieved by pulling in a same direction.

The present invention allows for replacement of the milling chisel separately from the quick-change chisel holder. Thus, not only should it be possible to install the tool device quickly and easily, but also to remove a potentially worn milling chisel or a quick-change chisel holder in the easiest and most time-saving manner possible. In particular, it should be possible to remove the milling chisel from the chisel holder as easily as possible and without special tools after releasing the fastening device, and also, if possible, without removing the quick-change chisel holder from the base holder. The tapering sections of the milling chisel and the quick-change chisel holder are therefore preferably designed in relation to each other in such a way that the quick-change chisel holder—particularly after releasing the fastening device—has a greater extraction force on the base holder than the milling chisel has on the quick-change chisel holder. This is achieved particularly easily by the fact that the tapering sections of the milling chisel and the quick-change chisel holder are shaped as truncated cones and the surface lines of the truncated cones respectively have an angle relative to the longitudinal axis of the milling chisel, and that the angle of the tapering section of the milling chisel is equally large or larger than the angle of the tapering section of the quick-change chisel holder. In particular, the truncated cone-shaped tapering sections of the milling chisel and the quick-change chisel holder are designed to be concentrical to each other. Due to the larger angle of the surface line of the truncated cone-shaped tapering section of the milling chisel compared to that of the quick-change chisel holder, the milling chisel can be removed more easily from the quick-change chisel holder by pulling against the pulling direction of the fastening device, particularly along the longitudinal axis of the milling chisel, than the quick-change chisel holder can be from the base holder. Thus, if such a pulling or tensile force is exerted on the milling chisel after releasing the fastening device, for example, by a wedge or a flat chisel between the chisel head and the chisel holder, it will slide out of the shaft receptacle and can be removed. In contrast, a higher pulling force is required to remove the quick-change chisel holder, whereby it is possible to simply keep the quick-change chisel holder in its installed position in the base holder after releasing the fastening device, and to refasten it by attaching the fastening device when installing a new milling chisel.

How much easier the removal of the milling chisel should be compared to the removal of the quick-change chisel holder is largely determined by the difference of the respective angles of the surface lines of the truncated cone-shaped tapering sections relative to the longitudinal axis of the milling chisel, as well as by the size of the contact surfaces. The greater the difference is, the easier the milling chisel can be removed compared to the quick-change chisel holder. Thus, it is preferred that the angle of the tapering section of the milling chisel relative to the longitudinal axis is greater than the angle of the tapering section of the quick-change chisel holder relative to the longitudinal axis by at least 0.2°, preferably by up to 2°, and more preferably by 0.8°. On the one hand, this angle range has proven to be particularly stable, and on the other hand, it has proven to be particularly advantageous for the separate removal of the milling chisel and the quick-change chisel holder.

As already mentioned, the milling chisel can be removed from the shaft receptacle of the quick-change chisel holder or the chisel holder, for example, by pulling on the chisel head. A flat chisel, for example, can be used for this, which is inserted between the chisel head and the chisel holder and with the help of which the milling chisel can then be levered out of the shaft receptacle. Alternatively, the milling chisel can be pressed out of the shaft receptacle from its face side opposite the chisel tip. To this end, it is preferred that the shaft receptacle and the holder receptacle respectively have an opening on their face sides opposite the chisel tip, said openings being positioned one behind the other, and that the milling chisel is guided through both the opening of the quick-change chisel holder as well as through the opening of the base holder. The end of the shaft, or the face side, of the milling chisel opposite the chisel tip is thus accessible through the opening in the base holder and the opening in the quick-change chisel holder. Thus, for example, a tool can be inserted here, with which pressure can be exerted on the milling chisel to drive it out of the chisel holder.

In principle, the milling chisel can thus be driven out by inserting a tool through the openings of the base holder and the quick-change chisel holder. To further simplify the removal of a worn chisel, however, it is preferred that no special tool is needed to drive the milling chisel out. To this end, it is advantageous if the milling chisel, with its shaft end opposite the chisel tip, projects out of the opening of the base holder and beyond the latter. Thus, when installed, the milling chisel protrudes from the chisel holder with the end of its shaft. It is therefore possible to drive the milling chisel out by stroking directly onto the end of the shaft using a conventional hammer. A special tool for replacing the milling chisel, for example, an expulsion mandrel is then no longer needed.

However, spatial conditions, for example, precisely in that area in which the end of the shaft of the milling chisel protrudes from the chisel holder, may be very restricted. Thus, it is preferable to remove the milling chisel from the chisel holder from the side of the chisel head. When the fastening device has been released, the milling chisel can be particularly easily removed from the chisel holder by inserting a tool, for example, a wedge or a flat chisel, between the chisel head and the chisel holder and by levering the milling chisel out of the chisel holder. To be able to insert such a tool, a clearance is provided between the chisel head and the chisel holder. In principle, the clearance can be created by the fact that the chisel head does not sit directly on the chisel holder when the tool device is assembled, but rather is spaced by a free space when viewed in the longitudinal direction. However, it is preferable if the chisel head, with its backside opposite the chisel tip, at least partially bears against the chisel holder. In this way, an additional beneficial force transfer from the milling chisel to the chisel holder may occur via the contacting surfaces. In addition, an expulsion recess is preferably provided between the chisel head and the chisel holder, in the area of which expulsion recess the chisel head is spaced from the chisel holder, thereby creating the clearance, and in which a tool can be inserted. Thus, overall, it is preferable if the tool device has an expulsion recess, which is designed in such a way that, when the tool device is assembled, there is a clearance between the chisel holder and a face side of the chisel holder opposite the backside of the chisel head. The milling chisel can be removed particularly quickly and easily by levering it out by means of a tool inserted into the clearance. At the same time, however, it is preferable if the chisel had at least partially bears against the face side of the chisel holder.

In principle, the expulsion recess may be designed in any manner that allows for a tool for levering the milling chisel out to be inserted between the chisel head and the chisel holder. The expulsion recess may be designed, for example, as a notch with rounded or flat sidewalls. However, the expulsion recess can be particularly easily implemented as a slant or chamfer. The chamfer does not need to extend around the entire ring surface of the chisel holder and/or the backside of the chisel head; instead, it is sufficient to provide such an expulsion recess at at least one location. It may be located either on the chisel head or on the chisel holder or also on both components. It is particularly preferred that the expulsion recess is designed as a slant on the backside of the chisel head, particularly a slant with an angle relative to a vertical to the longitudinal axis of the milling chisel in the range of from 15° to 25°, preferably in the range of from 18° to 22°, and more preferably of 20°. Alternatively, the expulsion recess is designed as a notch. The replacement of the milling chisel is considerably simplified and expedited through the described embodiment. The expulsion recess particularly preferably consists of two pieces with two opposed partial recesses relative to the longitudinal axis of the chisel, said two partial recesses very particularly preferably being designed symmetrically identical.

The fastening device for the milling chisel or the milling chisel and the quick-change chisel holder can principally be designed in a different manner. In one embodiment, the fastening device involves a traction device, which is capable of exerting a pulling force on the milling chisel and thus bracing the milling chisel in the shaft receptacle. The fastening device therefore clamps the milling chisel in the quick-change chisel holder, or in the chisel holder, and retains it there. This can be very easily achieved if the fastening device comprises a threaded connection. The fastening device can principally be arranged on any section of the chisel shaft. However, the pulling force on the milling chisel can be particularly easily achieved if the fastening device is arranged on the end of the milling chisel opposite the chisel tip, i.e., the end of the shaft. It is therefore preferred that the milling chisel has a fastening section with an external thread on the shaft end opposite the chisel tip, and that the fastening device is a nut, particularly a self-locking nut, which engages in a screw connection in the fastening section against the chisel holder. The pulling force is therefore effected by the nut being screwed against the chisel holder; the chisel shaft of the milling chisel then acting as a tie rod. The tightening torque of the fastening device in this case is, for example, in the range of 100 Nm. As a result, the milling chisel is pulled into the shaft receptacle towards the fastening device through the opening of the quick-change chisel holder and through the opening of the base holder. The milling chisel is braced in the shaft receptacle through the stop of the tapering section of the chisel shaft against the shaft receptacle. The nut is attached with common tools from the back of the chisel holder. As the fastening section of the milling chisel, which bears the external thread, protrudes at least partially from the opening in the base holder and beyond the base holder, the external thread can be accessed particularly easily for installing the fastening device. In principle, the nut can be secured against gradual loosening during work operation by means of any approach known in the prior art, thus, for example, by counter tightening with another nut or by using a castle nut. However, it is preferable if the nut is a self-locking nut with a plastic ring. Overall, the fastening device can therefore be attached and removed in a quick, uncomplicated, and simple manner based on the fastening device according to the invention, whereby the installation and removal of the milling chisel can be accelerated.

Wearing of prior art milling chisels or tool devices is frequently accelerated by the fact that crushed milled material and/or water with milled material penetrates between the chisel shaft and the chisel holder and leads to increased wear through abrasion. To prevent this, it is preferred that a sealing disk is present, which is braced between the nut and the chisel holder, and which seals the shaft receptacle of the chisel holder to the outside. In this connection, the sealing disk may be, for example, a conventional elastic plastic gasket. Providing the sealing disk prevents that water and/or milled material can penetrate through the opening of the base holder into the holder receptacle and/or the shaft receptacle of the chisel holder. This measure therefore likewise serves to extend the service life of the tool device.

The present invention is particularly suited for non-rotating milling chisels with a highly wear-resistant chisel tip. To further minimize the wear of the chisel head, those parts and/or sides of the chisel head that are in abrasive contact with the milled material during work operation may be designed at least partially, or especially completely, with a protective layer consisting of wear-resistant material. This protective layer may consist, for example, of hard metal, particularly tungsten carbide, and be implemented as a cap surrounding the chisel head. Due to the protective layer being formed as a cap, a particularly effective wear protection layer may be formed with a relatively small amount of expensive hard metal being required for manufacturing the cap. Thus, it is preferred that the milling chisel has a wear protection cap made of tungsten carbide, the chisel tip being attached to the wear protection cap by means of hard-soldering and the wear protection cap being attached to the base body by means of hard-soldering. The protected base body may then consist, for example, of steel or a similar material. The soldering temperature is preferably below 660° C. so as to prevent impairment of the material properties of the base body of the milling chisel. Alternatively, the wear protection layer may also be adhered to the chisel head of the base body. In particular, it is preferred that the tool device according to the invention has wear protection as described in DE 10 2014 014 094.6 of the same applicant. Reference is hereby made to said document with respect to wear protection. By providing such a wear protection cap on the milling chisel according to the invention, the service life of the tool device can be further extended, whereby the efficiency of the tool device increases overall.

In principle, the frictional connection according to the invention between the milling chisel and the chisel holder reliably prevents the milling chisel from rotating during work operation. To reliably and permanently prevent the tool from rotating in the shaft receptacle even under the most extreme operating conditions, it is advantageous if the milling chisel and the chisel holder are designed in such a way that a form locking device is present between the milling chisel and the chisel holder to secure it against rotation, which is designed in such a way that it prevents the milling chisel from rotating about its longitudinal axis in the chisel holder. Thus, preferably those forces that would cause the milling chisel to rotate can be reliably diverted from the milling chisel into the chisel holder via the form lock.

Accordingly, the form locking device is preferably designed in such a way that a form lock between the milling chisel and the chisel holder is enabled in the circumferential direction to the longitudinal axis of the milling chisel, ideally in both possible directions of rotation.

Such a form lock may be achieved between the milling chisel and the chisel holder by means of a number of potential specific designs. For example, the chisel shaft, as well as the shaft receptacle complementary to it, may have an oval or polygonal design, particularly in the cross-section vertically to the longitudinal axis. Rotation of the milling chisel in the shaft receptacle is then no longer possible. However, mutually engaging structures on the milling chisel and on the chisel holder, particularly in the direction of the longitudinal axis and not surrounding it, are easier to manufacture. Thus, it is preferred that a recess is provided on the chisel holder and that a projection is provided on the milling chisel, or vice versa, the recess and the projection being formed complementary to each other in such a way that they engage each other in a form locking manner when the tool device is assembled, and the chisel holder is prevented from rotating about its longitudinal axis. The projection may have, for example, a pin- or a tooth-like structure. For example, the projection may also have the shape of a crown gear.

It is possible to provide the projection on the milling chisel and the recess on the chisel holder or vice versa. Also, the projection and the recess may be arranged at any location, as long as they do not prevent the installation of the milling chisel on the chisel holder. For example, it is possible to provide the projection or the recess on the chisel shaft and in the shaft receptacle. The projection or the recess may also be provided on the chisel head, particularly on the wear protection cap of the chisel head. An arrangement on the wear protection cap has the advantage that the latter consists of a hard metal and the form locking elements therefore wear especially minimally, so that the form lock can be ensured for the entire service life of the milling chisel. A particularly preferred embodiment emerges if the recess is formed on the ring surface of the chisel holder situated opposite the backside of the chisel head and the projection is formed on the backside of the chisel head, in particular integrally with a wear protection cap. In this case, an installer can see the elements very well and therefore particularly easily install the milling chisel on the chisel holder.

A projection and a complementary recess suffice for achieving an extremely strong and reliable solution for securing the milling chisel against rotation. A particularly reliable solution for securing against rotation, however, is achieved if multiple projections or recesses are provided. Multiple expulsion recesses may also be provided. Accordingly, multiple gaps for levering the milling chisel out are also designed. In this case, the projections or recesses are preferably arranged so as to alternate with the expulsion recesses in the circumferential direction of the chisel shaft or the chisel head. This can ensure that the forces acting on the milling chisel, which would cause the milling chisel to rotate in the chisel holder if not secured against rotation, are safely diverted.

It is particularly advantageous if the projections or the recesses and the expulsion recesses are arranged in such a way that the milling chisel can be installed homogenously in the chisel holder in different rotational positions (in terms of rotation about its longitudinal axis). In this context, homogenous means that, for each possible installation of the milling chisel in a rotational position, the same arrangement of projections, recesses, and expulsion recesses is provided in the tool device as in all other rotational positions of the milling chisel. In other words, it is preferred that the projections or recesses and expulsion recesses are systematically arranged in such a way that the milling chisel can be mounted twisted by 90°, more preferably by 180°, without changing the configuration of the projections or recesses and expulsion recesses in the tool device. Moreover, smaller angle ranges are also conceivable. Through this design of the tool device, it is possible to remove the milling chisel after a certain period of use in order to rotate it, for example, by 90° or 180°, and reinstall it on the chisel holder. Asymmetrical and therefore faster wear can thus be prevented, whereby the service life of the milling chisels is increased.

The aforesaid object of the invention is further achieved with a milling chisel and/or with a quick-change chisel holder for a tool device described above. All described features and benefits of the milling chisel or the quick-change chisel holder apply accordingly.

The object is further achieved with a ground milling machine with a tool device described above. The ground milling machine, which may in particular be a road construction machine of the road milling machine, recycler or stabilizer type or a surface miner, preferably has a plurality of tool devices as described above mounted on its milling drum.

BRIEF DESCRIPTION OF THE DRAWINGS

The invention will be explained in further detail below with reference to the exemplary embodiments illustrated in the figures. In the schematic figures.

DETAILED DESCRIPTION

Like components are designated by like reference signs. Recurring components are not separately designated in all figures.

Figure 1:
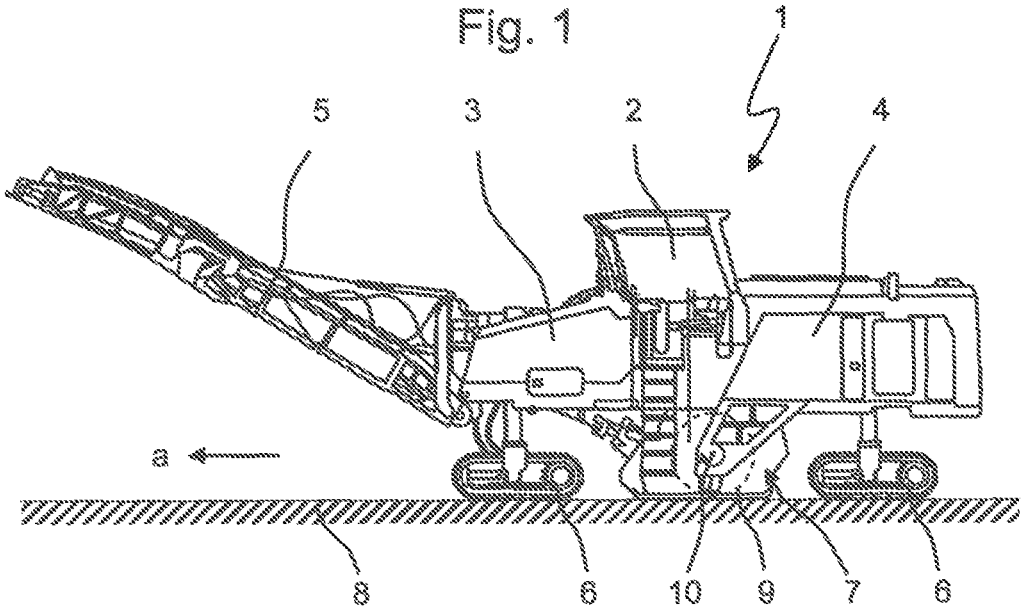
FIG. 1 is a side view of a ground milling machine.

FIG. 1 shows a ground milling machine 1, in this case, a road-milling machine of the center rotor cold milling machine type. The ground milling machine 1 comprises an operator's platform 2 with a driver's seat and a control panel, a machine frame 3, and a drive engine 4. The drive engine 4, for example, a diesel engine, powers inter alia the running gears 6, the milling drum 9, and the discharge conveyor 5. The milling drum 9 is mounted in the milling drum box 7 such that it can rotate about a rotation axis 10 extending horizontally and transversely to the working direction a. During work operation of the ground milling machine 1, the milling drum 9 mills the ground 8 in the working direction a. Loose milled material is transferred via the discharge conveyor 5 to a transport vehicle not depicted and hauled away by it.

Figure 2:
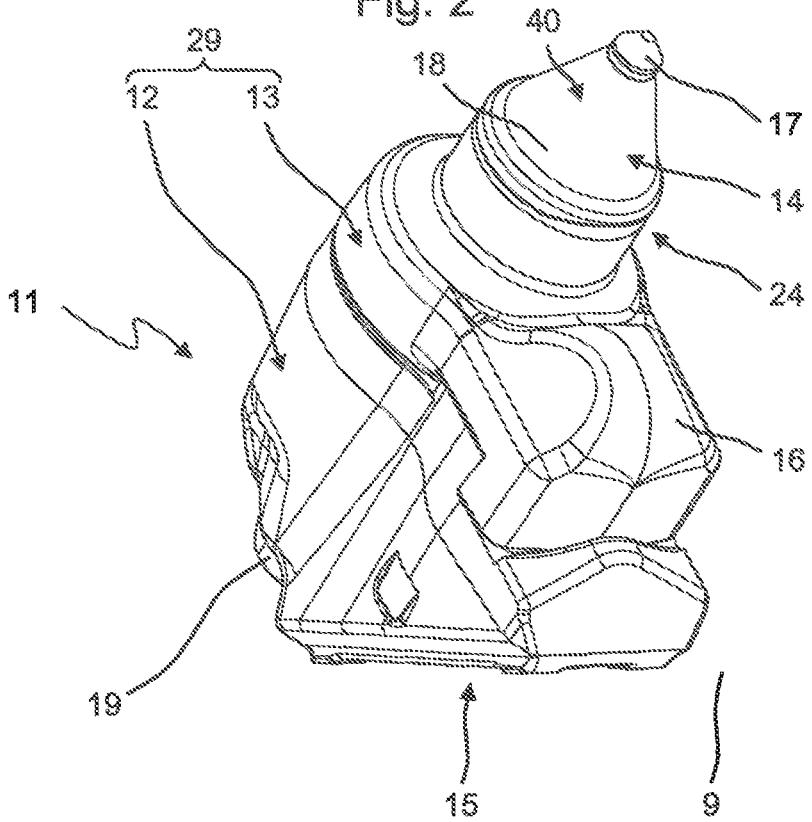
FIG. 2 is a perspective view of a tool device from the diagonal front right.

To mill the ground 8, the milling drum 9 is equipped with tool devices 11, one of which is depicted in the perspective view of FIG. 2. The tool device 11 comprises a milling chisel 14 and a chisel holder 29. In the exemplary embodiment shown, the chisel holder 29 has a two-piece design and comprises a base holder 12 connected to the milling tube of the milling drum and a quick-change chisel holder 13. The base holder 12 is welded to the milling tube of the milling drum 9 via its bottom side 15. It is also possible to attach the base holder 12 with its bottom side 15 to a platform not depicted or to a segment of another support structure, which platform or support structure may in turn be attached, for example, welded on the milling tube. What is essential is that the base holder 12 is connected directly or indirectly to the milling tube via its bottom side 15. The quick-change chisel holder 13 attached on the base holder 12 has a projection designed as a chip breaker 16, which is used in work operation to crush blocks of milled material and to direct milled material past the chisel holder 29. Furthermore, the quick-change chisel holder 13 engages an undercut of the base holder 12 in the area of chip breaker 16 in a form locking manner and thus contributes to a positive force transfer, particularly of forces that are directed vertically to the longitudinal axis of the milling chisel 14. The milling chisel 14 is partially accommodated by the chisel holder 29 and is retained therein by the fastening device 19, which in this case is a self-locking nut, so that the milling chisel 14 is fastened to the milling drum 9 by the chisel holder 29.

Figure 3:
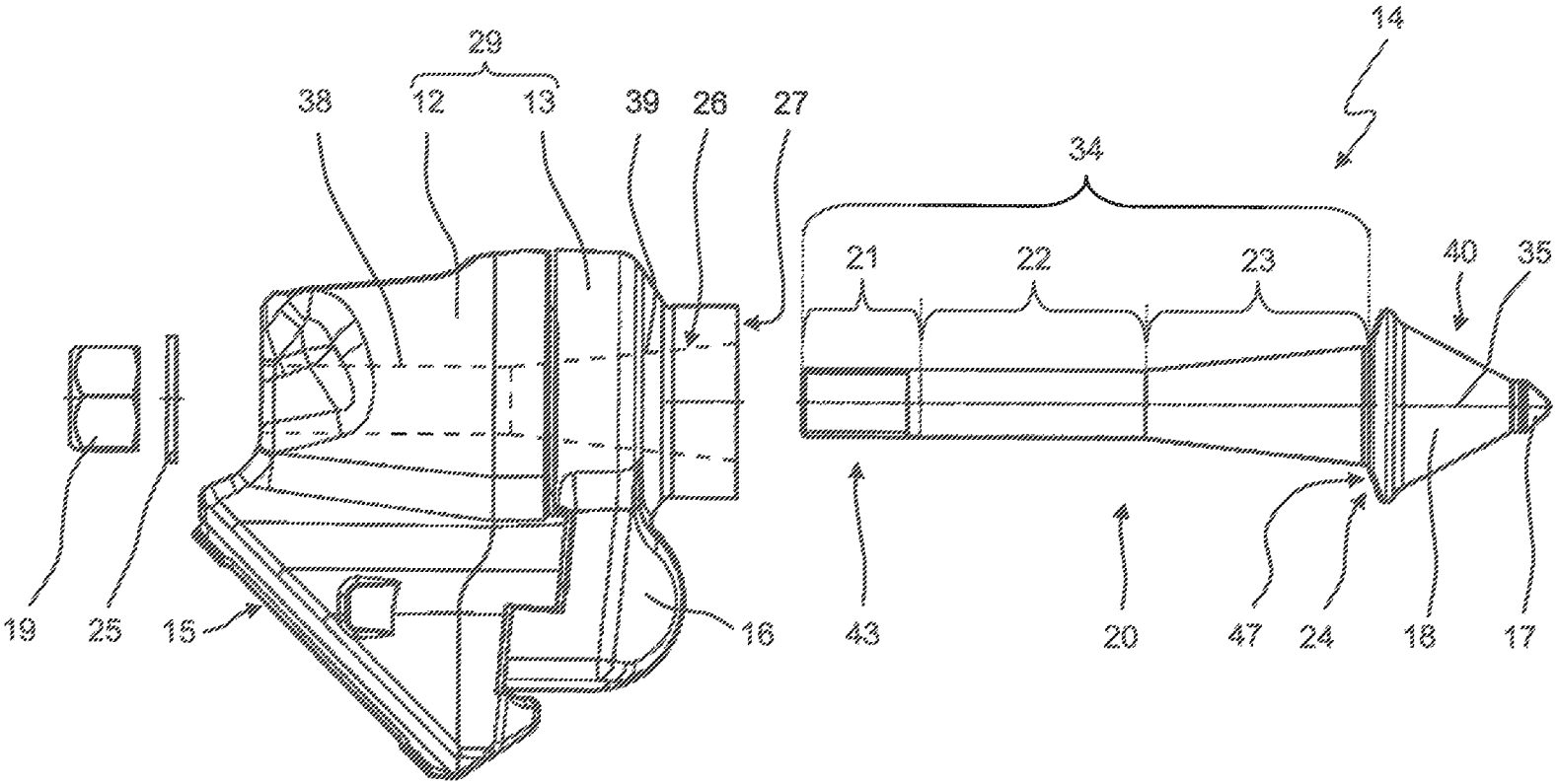
FIG. 3 is an exploded view of a tool device.
Figure 4:
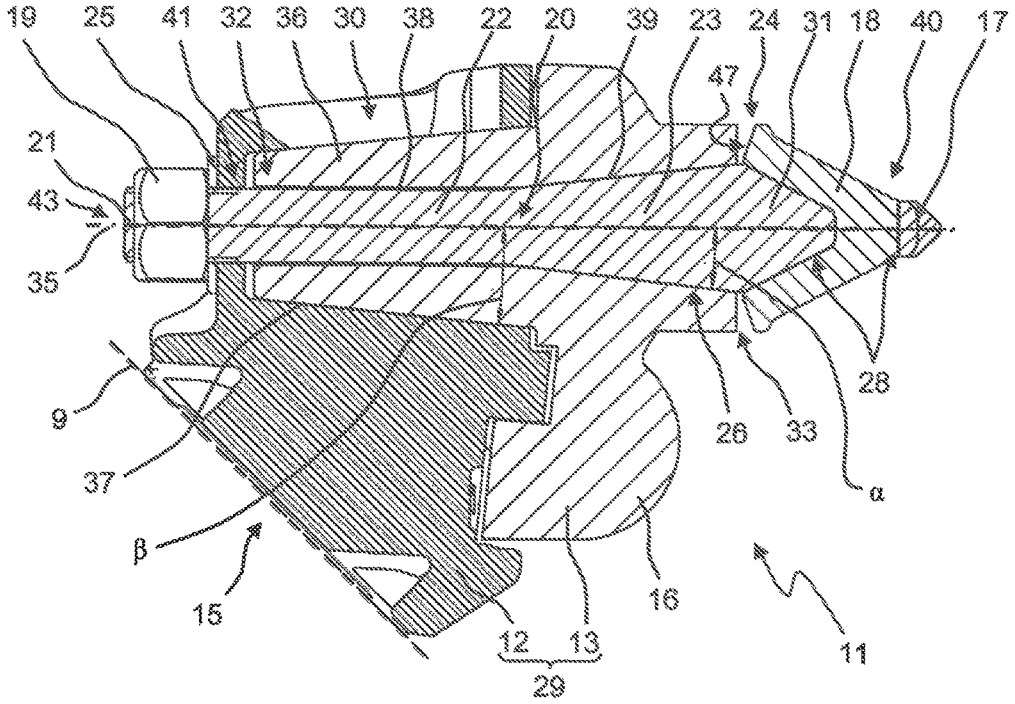
FIG. 4 shows a longitudinal cross-section through a tool device.
Figure 5:
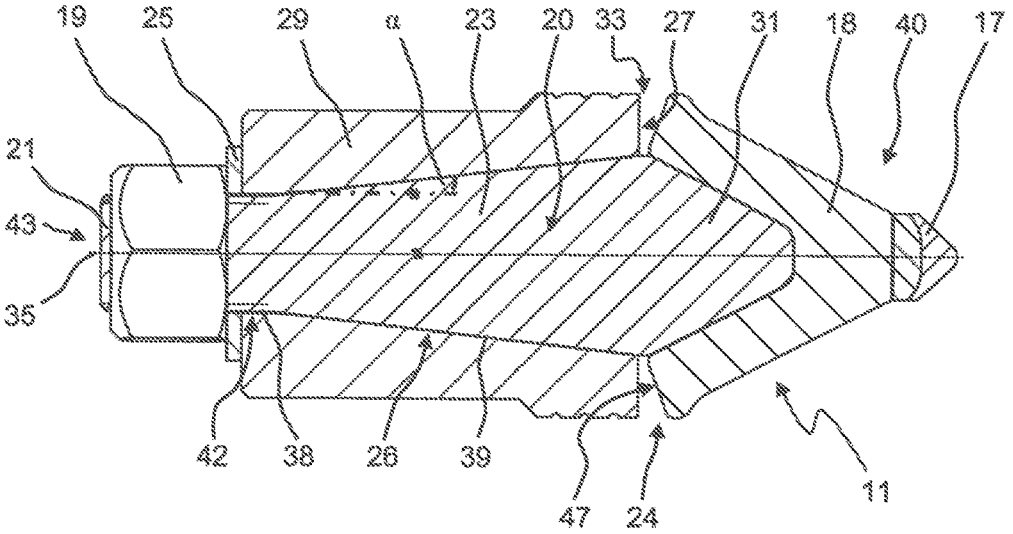
FIG. 5 shows a longitudinal cross-section through another tool device.

FIGS. 3 and 4 further illustrate the design of milling chisel 14. FIG. 3 shows the milling chisel 14 in a side view, while FIG. 4 is a longitudinal cross-sectional side view through the milling chisel 14 installed in the chisel holder 29 along the longitudinal axis 35 of the milling chisel of FIG. 3. The milling chisel 14 comprises a chisel head 40 and a chisel shaft 20. The chisel head 40 in turn comprises a chisel tip 17 with PCD material and a wear protection cap 18 consisting of hard metal, in this case tungsten carbide. In the area in which the chisel head 40 covers the chisel holder 29 or the quick-change chisel holder 13, the milling chisel 14 may either rest directly on the ring surface 27 surrounding the shaft receptacle 26 or be minimally spaced from it without there being direct contact between the ring face 27 and the tool head 40, as is shown in FIGS. 4 and 5. In this area, there is then a clearance 33, which will be described in further detail below.

As illustrated in particular in the sectional view of FIG. 4, the wear protection cap 18 surrounds a base body 31 of the milling chisel 14 in the area of the tool head 40. Due to the design of the wear protection cap 18 as a cap, on the one hand, the chisel achieves a high resistance to wear and, on the other hand, hard metal material is saved. The chisel tip 17 is attached to the wear protection cap 18 by means of hard-soldering at a soldering spot 28. The wear protection cap 18 in turn is attached to the base body 31 of the milling chisel 14 by means of hard-soldering at another soldering spot 28. Overall, the milling chisel 14 extends along the longitudinal axis 35. In the illustrated exemplary embodiment, the milling chisel 14 is designed rotationally symmetric about the longitudinal axis 35. In the present context, the chisel shaft 20 is that part of the milling chisel 14 which directly adjoins the chisel head 40 opposite the chisel tip 17. The chisel shaft 20 is designed integral with the base body 31 of the milling chisel 14 and consists, for example, of heat-treated steel, particularly 42CrMo4. Overall, the chisel shaft 20 therefore forms a tie rod with a tensile strength of at least 800 $N/mm^2$.

The chisel shaft 20 serves to fasten the milling chisel 14 to the chisel holder 29, while the chisel head 40 serves to cut and crush the ground material. For this purpose, the chisel shaft 20 has a shaft length 34 along the longitudinal axis 35 of the milling chisel 14, which comprises multiple sections of the chisel shaft 20. That is, the chisel shaft 20 has a tapering section 23, a cylindrical section 22, and a fastening section 21. The tapering section 23 directly adjoins the chisel head 40 on the backside 47 of the chisel head 40 opposite the chisel tip 17. It is characterized by the fact that it narrows from the side directed towards the chisel head 40 in the direction towards the shaft end 43 with respect to its cross-section transversely to the longitudinal axis. Thus, in the tapering section 23, the diameter or the cross-sectional area of the chisel shaft 20 decreases along the longitudinal axis 35 in the direction towards the shaft end 43. In the illustrated exemplary embodiment, the tapering section 23 is shaped as a truncated cone and does not extend along the entire shaft length 34, but connects to another cylindrical section 22 having a constant diameter or cross-sectional area along the longitudinal axis 35. On the shaft end 43, there is provided a fastening section 21, which is likewise cylindrical, having an external thread, which is used for fastening the milling chisel 14 in the chisel holder 29, as will be described in further detail below.

The fastening of the milling chisel 14 in the chisel holder 29 can be seen in particular in an overview of FIGS. 3 and 4. The chisel holder 29 has a shaft receptacle 26, which is designed complementary to the shape of the chisel shaft 20. In the illustrated exemplary embodiment, this means that the shaft receptacle 26 also has a tapering section 39 and a cylindrical section 38. The tapering section 39 of the shaft receptacle 26 is designed particularly in such a way that the lateral surface of the truncated cone-shaped tapering section 23 of the chisel shaft 20 fully bears against the inner wall of the shaft receptacle 26 in the tapering section 39 when the milling chisel 14 is installed in the chisel holder 29. The shaft receptacle 26 extends through the entire chisel holder 29, including the quick-change chisel holder 13 and the base holder 12. The shaft end 43 and, at least partly, also the fastening section 21 of the chisel shaft 20 protrude out of the chisel holder 29 on its end opposite the chisel tip 17. For this purpose, the chisel shaft 20 is guided through an opening 32 in the quick-change chisel holder 13 and an opening 41 in the base holder 12. A fastening device 19, in this case, a self-locking nut, is screwed onto the external thread of the fastening section 21, which is screwed on with a sealing disk 25 against the chisel holder 29. A pulling force is exerted on the milling chisel 14 by firmly tightening the fastening device 19, which pulls the milling chisel 14 into the shaft receptacle 26 of the chisel holder 29. In doing so, the pulling force of the fastening device 19 is so strong that the milling chisel 14, with the tapering section 23 of the chisel shaft 20, bears against the tapering section 39 of the shaft receptacle 26 in a frictionally locking manner and is firmly fixed in particular during work operation, i.e., does not rotate and is secured against rotation during milling operation.

FIG. 4 illustrates that, according to the present invention, the fastening device 19 for the milling chisel 14, in the case of a two-part chisel holder 29, is used to fasten the milling chisel 14 to the quick-change chisel holder 13 as well as the quick-change chisel holder 13 to the base holder 12. For this purpose, the base holder 13 has a holder receptacle 37, which is designed complementary to a tapering section 36 of the quick-change chisel holder 13. The tapering section 36 of the quick-change chisel holder 13 also narrows in the pulling direction of the fastening device 19 analogously to the tapering section 23 of the chisel shaft 20. In the illustrated example, the tapering section 36 of the quick-change chisel holder 13 is likewise designed as a truncated cone. Through the pulling force exerted by the fastening device 19, the quick-change chisel holder 13 is pulled into the holder receptacle 37, the tapering section 36 of the quick-change chisel holder 13 bearing against the inner wall of the holder receptacle 37 in a frictionally locking manner. The quick-change chisel holder 13 is further secured against rotation relative to the base holder 12 by the quick-change chisel holder 13 engaging an undercut of the base holder 12 in the area of the chip breaker 16.

Overall, therefore, for installing the tool device 11 according to FIGS. 2, 3, and 4, the base holder 12 is welded onto the milling drum 9. The quick-change chisel holder 13 is then inserted into the holder receptacle 37, and the milling chisel 14 is inserted into the shaft receptacle 26 until the fastening section 21 of the chisel shaft 20 protrudes from the backside opening 41 of the base holder 12. Thereafter, the fastening device 19 and the sealing disk 25 are screwed onto the fastening section 21, i.e., its external thread. By screwing the fastening device 19 against the chisel holder 29, all components of the tool device 11 are fastened to each other. To remove a worn milling chisel 14, the fastening device 19 must be released. After that, the milling chisel 14 can be driven out from the chisel holder 29 by effecting strokes onto the protruding fastening section 21 on the shaft end 43 with a conventional hammer. To ensure that the milling chisel 14 is driven out of the shaft receptacle 26 without the quick-change chisel holder 13 likewise being released from the holder receptacle 37, the angle $\alpha$ of a surface line of the truncated cone-shaped tapering section 23 of the chisel shaft 20 relative to the longitudinal axis 35 of the milling chisel 14 is greater than the angle $\beta$ of a surface line of the truncated cone-shaped tapering section 36 of the quick-change chisel holder 13 relative to the longitudinal axis 35. As a result, the expulsion force of the milling chisel 14 in the quick-change chisel holder 13 is less than the expulsion force of the quick-change chisel holder 13 in the base holder 12. The auxiliary line provided in FIG. 5 for depicting the angle $\alpha$ is parallel to the longitudinal axis 35 of the milling chisel 14. Due to the fact that the angle $\alpha$ of the milling chisel is greater than the angle $\beta$ of the quick-change chisel holder 13, only the milling chisel 14 is released from the shaft receptacle 26 upon an impact on shaft end 43, whereas the quick-change chisel holder 13 remains in the holder receptacle 37. If the quick-change chisel holder 13 is also to be replaced, the expulsion opening 30 in the base holder 12 can be used for this, through which, for example, a suitable tool may be inserted in the base holder 12, with which the quick-change chisel holder 13 can be driven out of the holder receptacle 37.

FIG. 5 shows a tool device 11 with a one-piece chisel holder 29. In this case too the chisel holder 29 receives the milling chisel 14 and is welded directly onto the milling drum 9 or welded to the milling drum tube via a platform or a segment of a support structure. Thus, apart from the structural division into quick-change chisel holder 13 and base holder 12, all previous explanations also apply for the tool device 11 according to FIG. 5. In particular, the shaft receptacle 26 of the chisel holder 29 according to FIG. 5 corresponds to the shaft receptacle 26 of the quick-change chisel holder 13. Also, the one-piece chisel holder 29 according to FIG. 5 likewise has an opening 42, from which the milling chisel 14 projects on the end opposite the chisel tip 17.

Figure 6:
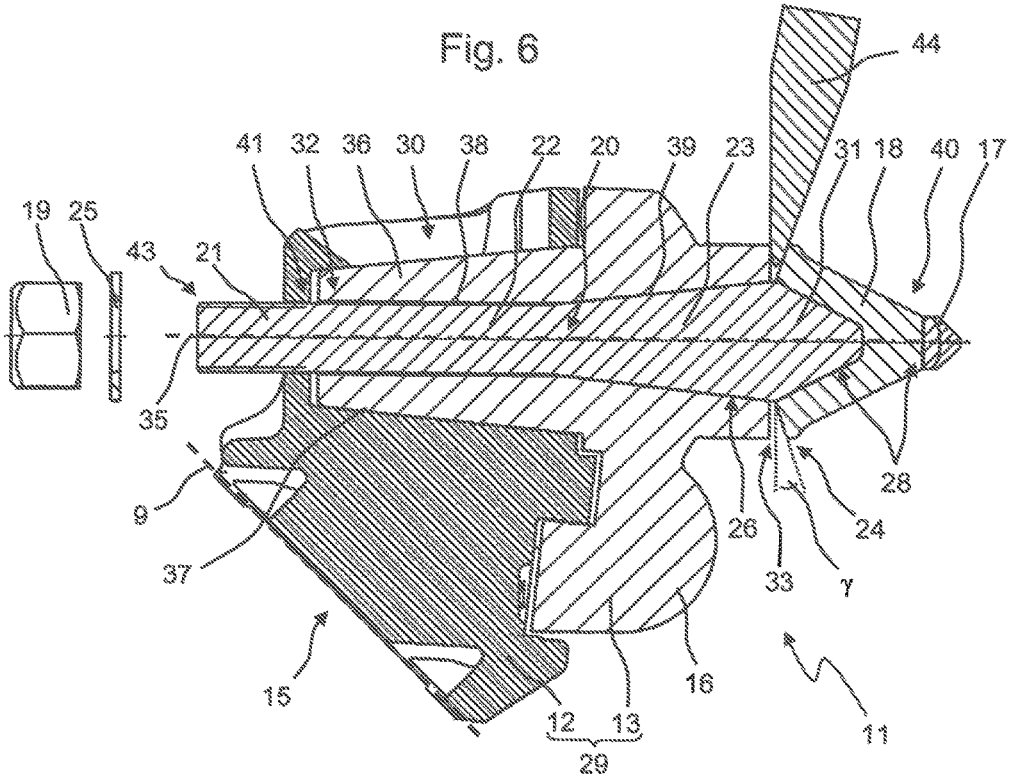
FIG. 6 shows a longitudinal cross-section through a tool device as the milling chisel is being detached.
Figure 7:
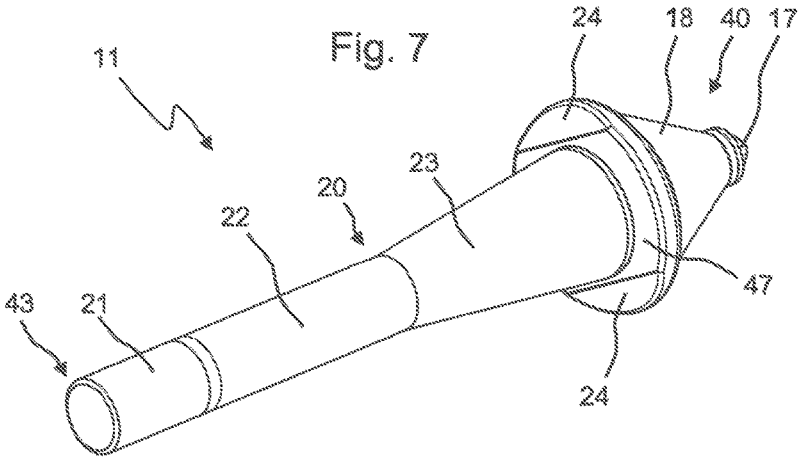
FIG. 7 is a perspective view of a milling chisel from the diagonal back.

An alternative option for removing the milling chisel 14 from the chisel holder 29 can be taken in particular from FIGS. 6 and 7. FIG. 7 shows an embodiment of a milling chisel 14, in which two expulsion recesses 24 are provided on the backside 47 of the chisel head 40, i.e., that side of the chisel head 40 which is located opposite the chisel tip 17. The expulsion recesses 24 are designed as inclined surfaces or chamfers, which, in the illustrated example, have an angle $\gamma$ (FIG. 6) of 20° relative to a vertical to the longitudinal axis 35 of the milling chisel 14. As can be seen in particular in FIG. 6, the expulsion recesses 24 form a clearance 33 between the chisel head 40 and the ring surface 27 of the chisel holder 29. If the fastening device 19 is released, as shown in FIG. 6, an installer can insert a tool, for example, a flat chisel 44, into the clearance 33 and use it as a lever to remove the milling chisel 14 from the chisel holder 29, i.e., the quick-change chisel holder 13. The arrangement of multiple expulsion recesses 24 in the circumferential direction of the chisel shaft 20 or the chisel head 40 has the advantage that the milling chisel 14 can be installed in any rotational position (with respect to a rotation about its longitudinal axis 35) in the chisel holder 29, and an installer will still always have easy access to at least one expulsion recess 24.

Figure 8:
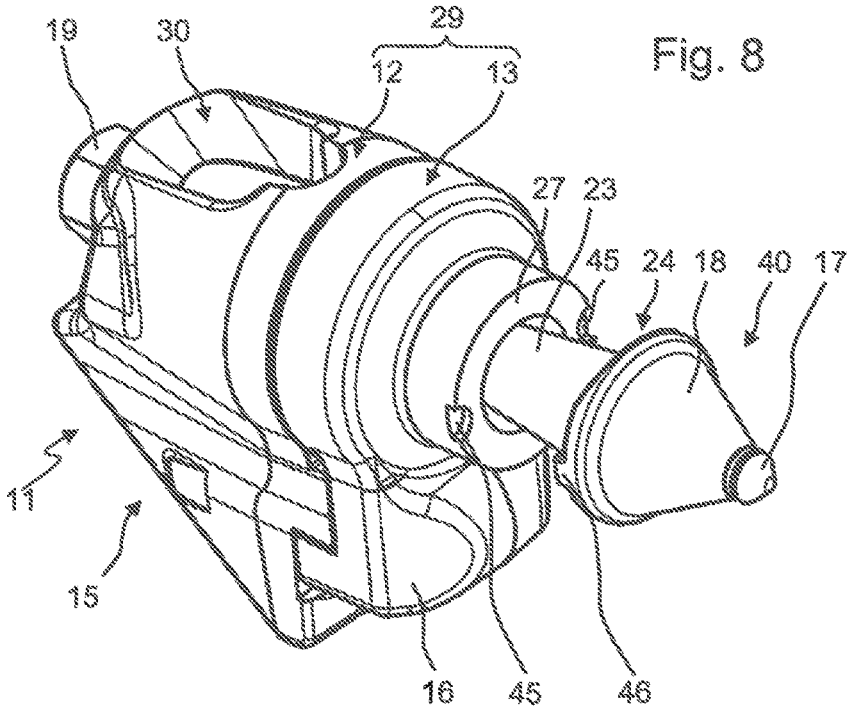
FIG. 8 is a perspective view of a tool device with a partially detached milling chisel from the diagonal front right.
Figure 9:
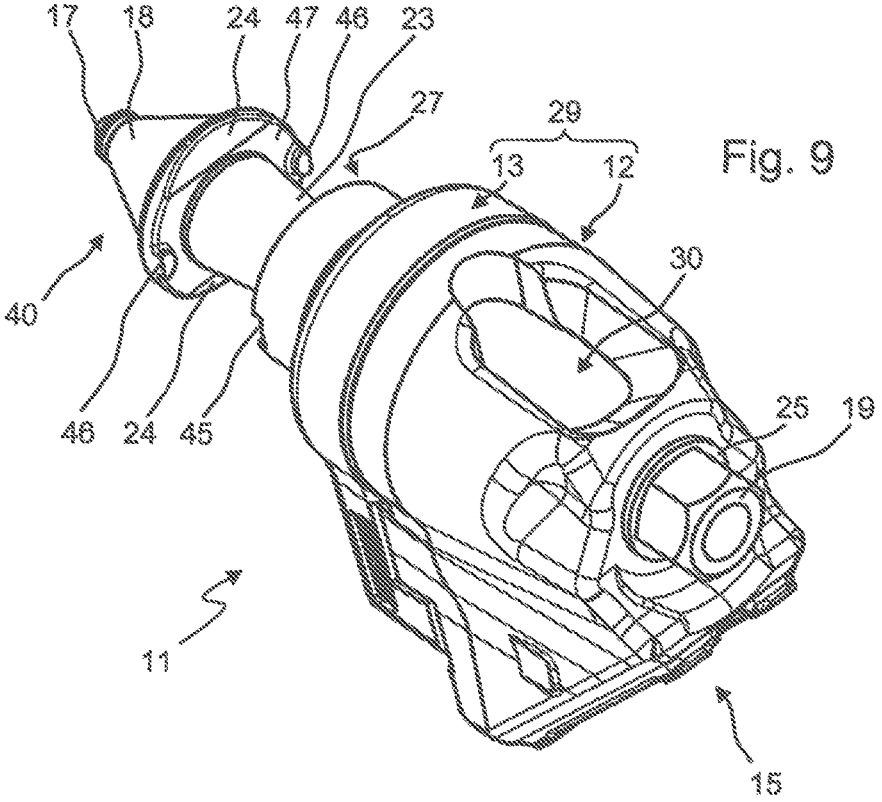
FIG. 9 is a perspective view of a tool device with a partially detached milling chisel from the diagonal left back.

Another embodiment is shown in FIGS. 8 and 9, where the tool device 11 has an anti-rotation device, which prevents the milling chisel 14 from rotating about the longitudinal axis 35. Specifically, the milling chisel 14 has two opposite projections 46 on the backside 47 of the chisel head 40, which are designed complementary to two recesses 45 provided on the ring surface 27 of the chisel holder 29 or the quick-change chisel holder 13. The two projections 46 and the recesses 45 are formed opposite each other. They are in particular arranged symmetrically with respect to the longitudinal axis 35. When the milling chisel 14 is inserted into the chisel holder 29, the projections 46 engage the recesses 45 in a form locking manner. The milling chisel 14 is therefore prevented from rotating about its longitudinal axis 35.

Moreover, the milling chisels 14 of the embodiment shown in FIGS. 8 and 9 likewise have expulsion recesses 24 in the form of slants. The expulsion recesses 24 are also designed opposite each other on the backside 47 of the chisel head 40 and are in particular arranged symmetrically with respect to the longitudinal axis 35. With regard to the circumferential direction of the backside 47 of the chisel head 40, the expulsion recesses 24 and the projections 46 alternate. In this case, the tool device 11 is designed in such a way that the milling chisel 14 can be installed in two different positions on the chisel holder 29. Specifically, the milling chisel 14 can be rotated by 180° and be installed in this position on the chisel holder 29. Due to the symmetrical design of the projections 46 and the recesses 45, as well as the expulsion recesses 24, the same installation situation is created as prior to the rotation of the milling chisel 14. This means that the anti-rotation device engages in a form locking manner, and at least one expulsion recess 24 is readily accessible and easy to reach for an installer. In this manner, the milling chisel 14 can be removed after a certain period of use and be reinstalled after rotation by 180° in order to obtain more homogenous and therefore slower wear.

Overall, the tool device 11 according to the invention provides for an extended service life of the milling chisel 14, and the milling chisel 14 and the quick-change chisel holder 13 can be installed on the base holder 12 particularly easily and quickly, so that work breaks for replacing worn milling chisels 14 or quick-change chisel holders 13 can be minimized. Also, the total number of components of the tool device 11 can be reduced, and therefore costs saved, through the use of the common fastening device 19 for fastening the milling chisel 14 and the quick-change chisel holder 13.

What is claimed is:

1. A tool device for a ground milling machine, comprising:

a milling chisel comprising a chisel head and a chisel shaft extending along a longitudinal axis; and a chisel holder with a shaft receptacle;

wherein the chisel head comprises a wear-resistant chisel tip and a wear protection cap;

wherein the chisel tip is attached to the wear protection cap by hard-soldering, and the wear protection cap is attached to a body of the milling chisel by hard-soldering;

wherein the chisel shaft of the milling chisel has at least one tapering section narrowing in a direction away from the chisel tip;

a fastening device which fastens the milling chisel to the chisel holder;

wherein the shaft receptacle of the chisel holder is configured complementary to the chisel shaft of the milling chisel such that the tapering section bears against the chisel holder in the shaft receptacle in a frictionally locking manner;

wherein the chisel holder comprises a base holder and a quick-change chisel holder, the base holder comprising a holder receptacle for receiving the quick-change chisel holder, and the quick-change chisel holder comprising the shaft receptacle;

wherein the fastening device is operable such that the fastening device pulls, along the longitudinal axis and in a direction away from the chisel tip, the milling chisel into the shaft receptacle and the quick-change chisel holder into the holder receptacle in the base holder;

wherein a form locking device is disposed between the milling chisel and the chisel holder, the form locking device comprising at least one recess on a face side of the chisel holder opposite a backside of the chisel head and at least one projection on the backside of the chisel head which is formed integral with the wear protection cap, the at least one recess and the at least one projection engaging each other in a circumferential direction to the longitudinal axis with the at least one projection disposed within the at least one recess such that the milling chisel is prevented from rotating about the longitudinal axis in the chisel holder.

2. The tool device according to claim 1, wherein the chisel tip comprises a material with a Vickers hardness of at least HV 2400.

3. The tool device according to claim 1, wherein the chisel shaft has a shaft length, and the tapering section of the chisel shaft extends over at least 25% of the shaft length.

4. The tool device according to claim 1, wherein the tapering section of the chisel shaft directly adjoins the chisel head.

5. The tool device according to claim 1, wherein the quick-change chisel holder bears against the base holder in a frictionally locking manner and the milling chisel bears against the quick-change chisel holder in a frictionally locking manner.

6. The tool device according to claim 5, wherein the quick-change chisel holder has at least one tapering section, wherein the tapering section of the quick-change chisel holder bears against the base holder in the frictionally locking manner and the tapering section of the milling chisel bears against the quick-change chisel holder in the frictionally locking manner, and wherein the tapering section of the quick-change chisel holder and the tapering section of the milling chisel both narrow in the direction away from the chisel tip.

7. The tool device according to claim 6, wherein the tapering section of the quick-change chisel holder and the tapering section of the milling chisel are each shaped as a truncated cone, wherein a surface of the truncated cone of the milling chisel is at an angle ($\alpha$) relative to the longitudinal axis, and a surface of the truncated cone of the quick-change chisel holder is at an angle ($\beta$) relative to the longitudinal axis, and wherein the angle ($\alpha$) of the truncated cone of the milling chisel is as large as or larger than the angle ($\beta$) of the truncated cone of quick-change chisel holder.

8. The tool device according to claim 1, wherein the shaft receptacle and the holder receptacle each have an opening on a face side opposite the chisel tip, wherein the openings are positioned one behind the other, and wherein the chisel shaft of the milling chisel extends through the opening of the shaft receptacle and through the opening of the holder receptacle.

9. The tool device according to claim 1, further comprising an expulsion recess configured to facilitate removal of the milling chisel from the chisel holder, wherein the expulsion recess is disposed between the chisel head and the face side of the chisel holder opposite the backside of the chisel head, wherein the expulsion recess is formed as a slant or a notch on the backside of the chisel head.

10. The tool device according to claim 9, wherein the slant has an angle ($\gamma$) relative to a vertical to the longitudinal axis in the range of from 15° to 25°.

11. The tool device according to claim 1, wherein the chisel shaft of the milling chisel, on an end opposite the chisel tip, has a fastening section with an external thread, and wherein the fastening device is a nut which is screwed onto the external thread of the fastening section against the chisel holder.

12. The tool device according to claim 1, wherein the at least one recess of the form locking device comprises a plurality of recesses, and the at least one projection of the form locking device comprises a plurality of projections, wherein the plurality of recesses and the plurality of projections engage each other in the circumferential direction to the longitudinal axis with each one of the plurality of projections disposed in one of the plurality of recesses, respectively.

13. The tool device according to claim 12, wherein each one of the plurality of projections disposed in one of the plurality of recesses, respectively, is disposable in a different one of the plurality of recesses, respectively.

14. The tool device according to claim 13, wherein each one of the plurality of projections disposed in one of the plurality of recesses, respectively, is disposable in a different one of the plurality of recesses by rotation of the milling chisel relative to the chisel holder.

15. The tool device according to claim 13, wherein each one of the plurality of projections disposed in one of the plurality of recesses, respectively, is disposable in a different one of the plurality of recesses, respectively, without changing a configuration of the projections or the recesses.

16. The tool device according to claim 1, wherein the wear-resistant chisel tip comprises polycrystalline diamond and the wear protection cap comprises tungsten carbide.

17. The tool device according to claim 12, wherein at least one expulsion recess configured to facilitate removal of the milling chisel from the chisel holder is provided on the chisel head of the milling chisel, and wherein the at least one expulsion recess is disposed between two adjacent projections of the plurality of projections of the form locking device.

18. The tool device according to claim 17, wherein the at least one expulsion recess configured to facilitate removal of the milling chisel from the chisel holder provided on the chisel head of the milling chisel comprises a plurality of expulsion recesses configured to facilitate removal of the milling chisel from the chisel holder provided on the chisel head of the milling chisel, and wherein the plurality of expulsion recesses alternate on the chisel head with the plurality of projections of the form locking device.

19. A ground milling machine including the tool device according to claim 1.

* * * * *